US005807096A

United States Patent [19]

Shin et al.

[11] Patent Number: 5,807,096

[45] Date of Patent: Sep. 15, 1998

[54] DECORATIVE CANDLE ASSEMBLY

[76] Inventors: Haeng Chul Shin, Donglimhaicu 701, 390-6, Yongho3-dong, Nam-ku; Kang Jung Park, Usung A.P.T. 101-1407, 54, Kaegeum3-dong, Pusanjin-ku, both of Pusan, Rep. of Korea

[21] Appl. No.: 915,060

[22] Filed: Aug. 20, 1997

[30] Foreign Application Priority Data

Dec. 24, 1996 [KR] Rep. of Korea ..... 1996-56238

[51] Int. Cl.[6] ..... F23D 3/16

[52] U.S. Cl. ..... 431/253; 431/289

[58] Field of Search ..... 431/253, 289

[56] References Cited

U.S. PATENT DOCUMENTS 4,568,269 2/1986 Lin ..... 431/253

5,015,175 5/1991 Lee ..... 431/289

5,363,590 11/1994 Lee ..... 431/253

*Primary Examiner*—Carroll B. Dority

*Attorney, Agent, or Firm*—John L. Welch, Esq.

[57] ABSTRACT

The present invention provides a decorative candle assembly in which a sensor for sensing the burning of the candle is detachably attached to a circuit board, a cylindrical body of a candle support means is provided with a guide member having a vertical hole with a mouth of bugle or funnel shape, and a guttered wax catching unit is provided at the top of the support means, wherein it is possible to replace the damaged sensor and the burnt candle for prolonged reproduction of music and use of the assembly itself.

2 Claims, 2 Drawing Sheets

DECORATIVE CANDLE ASSEMBLY

BACKGROUND OF THE INVENTION

1. Field of the Invention

The present invention relates to a decorative candle assembly which emits a melody, musical tones or a spoken message when the candle is lighted for making festive moods, and more particularly to a decorative candle assembly which can continuously reproduce a melody by simply replacing a candle with another one and igniting the new candle, after the old candle is completely burnt out and for which candles of varying colors may be chosen and used.

2. Discussion of Related Art

In some decorative candles, a fibrous combustible wick and a heat or light transmitting means are axially embedded in the candle, while a battery and a music reproducing unit with a thermal or optical sensor are kept in the support means. The sensor can sense or detect the heat or light generated from the burning candle via the transmitting means and make electric current to flow in the music reproduction unit for activating the same.

In such a conventional decorative candle, however, the sensor is apt to be damaged by the heat generated from the burning candle and may not be reused after the candle is completely burnt.

In addition, since the sensor is fixed to the circuit board, the whole set of the music reproducing unit must be discarded, when the sensor is damaged, and this means waste of money and resources.

Further, since the heat or light transmitting means embedded in the candle serves as an electrode or electric contact for the music reproduction circuit, the support means must be combined with the candle to provide a correct connection between the sensor and the transmitting means.

Therefore, it is desirable that the candle is safely seated in the support means and should not be easily separated therefrom. Thus, it is almost impossible for the user to select the candle in his favorite color.

Even though they may be separated to replace the burnt candle or to change the candle, it is very difficult to restore the above described connection.

As the results, the conventional decorative candle cannot fully accomplish its original objects of providing festive moods by lignting a candle(s) in favorite color(s) and giving a melody or musical tones as long as the user wants to enjoy.

Another problem is that the melted wax runs down the support means or directly drops down on the congratulatory cake, for example, on which the decorative candle assembly is put.

Further, in order to embed the combustible wick and the transmitting means in the center of the candle, they must be inserted into a long and small hole formed at the center of the candle. It is difficult to pass the wick and the transmitting means through the small hole formed longitudinally at the center of the candle, and such a work results in low productivity. In addition, since the candle is made of soft material, it is apt to be easily deformed in its manufacturing process, making poor quality products.

SUMMARY OF THE INVENTION

Accordingly, the present invention is directed to a decorative candle assembly that substantially obviates one or more of the problems due to limitations and disadvantages of the related art.

An object of the present invention is to provide a decorative candle assembly which is designed such that a new candle may be easily mounted for replacing an old one or changing it to another in the user's favorite color or shape.

Another object of the present invention is to provide a decorative candle assembly in which the wick and the transmitting means can be easily embedded, thus enhancing the productivity and improving the quality of goods.

Still another object of the present invention is to provide a decorative candle assembly which can prevent the guttered wax from dropping down directly on the surface on which the assembly is placed.

Additional features and advantages of the invention will be set forth in the description which follows and in part will be apparent from the description, or may be learned by practice of the invention. The objectives and other advantages of the invention will be realized and attained by the structure particularly explained in the written description and claims hereof as well as the accompanying drawings.

To achieve these and other objects and in accordance with the objects of the present invention, as embodied and broadly described, a decorative candle assembly according to the present invention is characterized in that the sensor for sensing the burning of the candle is detachably attached to the circuit board of the music reproducing unit and the upper part of the support means has a bugle shape.

A guttered wax catching unit is provided at the top of the support means which is covered with a separate covering plate, thereby preventing the operation of the sensor and the music reproducing unit due to the accidental inflow of heat or light, and also the battery. In the decorative candle assembly of the present invention, the combustible wick, the transmitting means and the candle are fabricated into one unit in the candle manufacturing process.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate an embodiment of the invention and together with the description serve to explain the principles of the invention.

In the drawings.

DETAILED DESCRIPTION OF PREFERRED EMBODIMENT

Reference will now be made in detail to a preferred embodiment of the present invention, an example of which is illustrated in the accompanying drawings.

Figure 1:
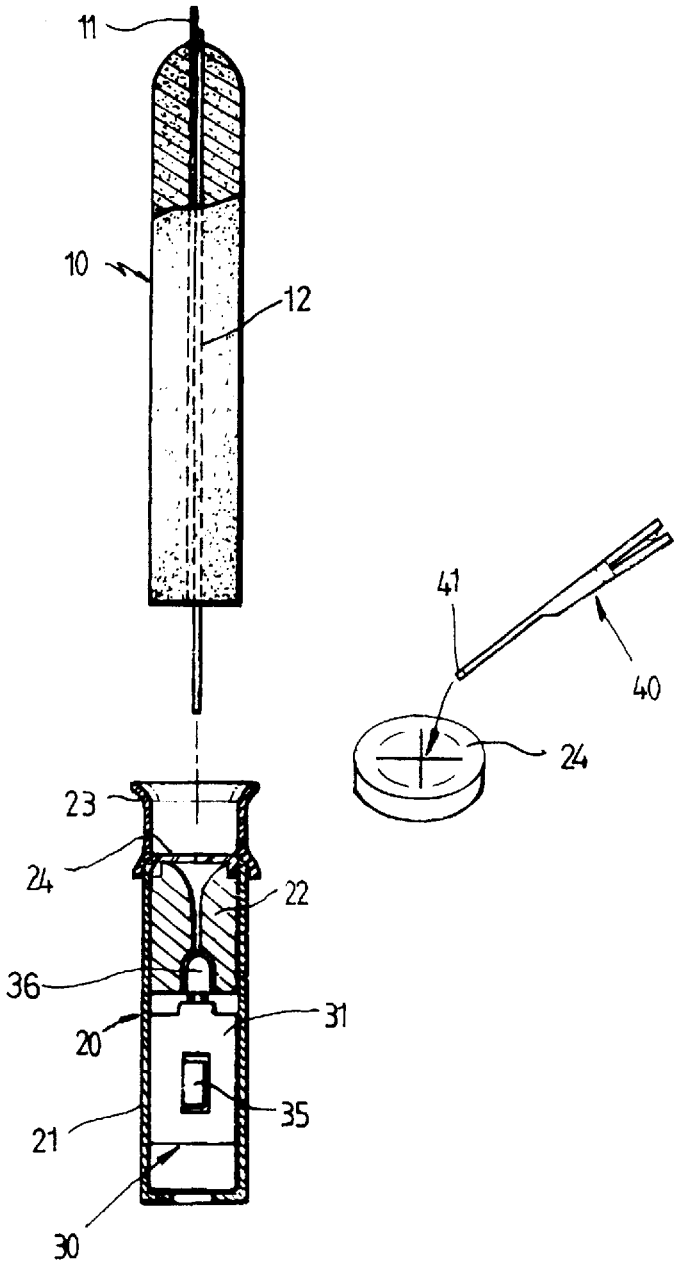
FIG. 1 is a sectional view showing a decorative candle assembly according to the present invention.

As shown in FIG. 1, the decorative candle assembly according to an embodiment of the present invention is divided into a candle 10 and a support means 20 in which the candle 10 is seated. A wick 11 and a light transmitting means 12 adjacent thereto are axially embedded in the candle 10.

The transmitting means 12 is made of an optical fiber. Accordingly, the sensor 36 for sensing the burning of the candle is an optical one. Any other materials can be used if they can transmit the heat or light generated during the burning of the candle to the sensor 36.

As previously described, the wick 11, the transmitting means 12 and the candle 10 are fabricated into one unit. That is, the combustible wick 11 and the transmitting means 12 are not inserted into a hole formed in the candle, but they are embedded in the candle 10 during the manufacturing process of the candle 10.

The support means 20 comprises a hollow body 21 made of synthetic resins or metal, a guide member 22 with a bugle- or funnel-shaped vertical hole which is positioned in the upper part of the body 21, a cover plate 24 closing the mouth of the body 21, a guttered wax catching unit 23 being put on the top of the body, and a music reproduction unit 30 placed in the lower part of the body 21.

In order to prevent the light from accidentally intruding through the support means into the sensor 36, the guide member 22 and the cover plate 24 desirably have a black color.

The center of the cover plate 24 serving to shield the light is split crosswise. The finished decorative candle assembly can be checked by a test device 40 via the split portion of the cover plate 24, to determine whether it operates normally.

That is, before packing or selling the decorative candle assemblies of the present invention, it is checked if music is reproduced or not by inserting a probe 41 of the test device 40 to reach the sensor 36. The test device is provided with a small lamp for emitting light. If the heat of the burning candle is used for activating the sensor, a heating wire is used for the checking probe 41.

Figure 2:
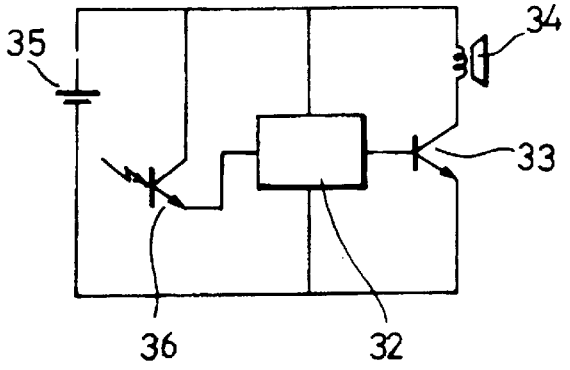
FIG. 2 is a electric circuit for activating the music reproducing unit in the assembly of FIG. 1.

As shown in FIG. 2, the music reproduction unit 30 comprises a melody IC 32 attached on a circuit board 31, a transistor 33 for amplifying the signals from the melody IC 32, a speaker 34 for converting the amplified signals to a sound or music, a battery 35 and a sensor 36 for switching the power from the battery to the circuit.

The sensor 36 is detachably attached to the circuit board 31 with a predetermined distance. When the sensor 36 is damaged and does not function normally due to the heat of the burning candle, it may be changed or replaced, but the music reproduction unit 30 or the support means 20 as a whole need not be discarded.

Figure 3:
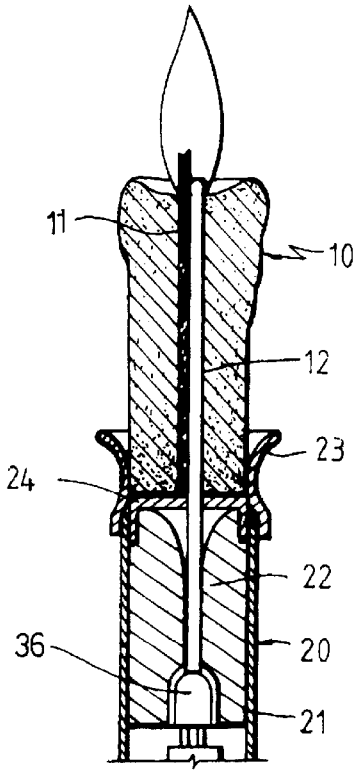
FIG. 3 shows a decorative candle assembly according to the present invention, in which a candle is seated in the support means.

FIG. 3 shows a decorative candle assembly as the combination of the candle 10 and the support means 20. In the drawing, the lower end of the transmitting means 12 which is projected from the candle 10 is inserted into the hole of the guide member 22 to be adjacent to or in contact with the sensor 36. As the result, the light or heat of the burning candle reaches the lower end of transmitting means 12 and is sensed by the sensor 36. At the same time, the music reproduction unit 35 operates to reproduce a merry music as desired.

The hole in the guide member 22 becomes wider at the upper portion thereof, thus making it easy to insert the lower end of the transmitting means 12. That is, even though the transmitting means 12 is placed eccentrically from the axis center of the candle 10, the lower end of the transmitting means 12 can easily reach the sensor 36 along the hole of the guide member 22. Therefore, in case of replacing a candle with another one after the candle is completely burnt out or during burning, the user can easily replace the candle without any concern of malfunction of the sensor due to the eccentricity.

As described above, the decorative candle assembly of the present invention can continuously reproduce a music even after a candle is completely burnt out by simply replacing it with another one and lighting the new candle. Also, it is possible for the user to select a candle of his favourite color and this enhances the efficiency of the decorative candle assembly.

In the meantime, the shape of the hole in the guide member 22 and the material of the cover plate 24 may vary without departing from the objects and structure of the present invention. Thus, it is intended that the present invention covers the modifications and variations of this invention, provided that they come within the scope of the appended claims and their equivalents.

What is claimed is:

1. A decorative candle assembly for providing a festive mood with a music reproduced, comprising:

a candle having a combustible wick and a light or heat transmitting means which are axially embedded therein and said light or heat transmitting means having an exposed lower end portion; and a support means having a cylindrical body, a guide member with a bugle shape vertical hole, a cover plate with a crosswise split portion provided at the top of the cylindrical body to close the mouth of the cylindrical body, and a music reproduction unit with a sensor which is detachably attached to the circuit board of the music reproduction unit and adjacent to or in contact with the lower end portion of the transmitting means and may be activated by the light or heat received from the burning candle through the transmitting means.

2. A decorative candle assembly as claimed in claim 1, wherein the support means is provided with a guttered wax catching unit on the top of it.

* * * * *